US009133849B2

(12) United States Patent
Sheth et al.

(10) Patent No.: US 9,133,849 B2
(45) Date of Patent: Sep. 15, 2015

(54) IMPELLER VANE WITH LEADING EDGE ENHANCEMENT

(71) Applicant: Baker Hughes Incorporated, Houston, TX (US)

(72) Inventors: Ketankumar K. Sheth, Tulsa, OK (US); Suresha R. O'Bryan, Joplin, MO (US); Risa Rutter, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 441 days.

(21) Appl. No.: 13/673,315

(22) Filed: Nov. 9, 2012

(65) Prior Publication Data

US 2013/0115047 A1 May 9, 2013

Related U.S. Application Data

(60) Provisional application No. 61/557,448, filed on Nov. 9, 2011.

(51) Int. Cl.

| | |
|---|---|
| ***F04D 29/38*** | (2006.01) |
| ***F04D 13/10*** | (2006.01) |
| ***F04D 1/08*** | (2006.01) |
| ***F04D 1/10*** | (2006.01) |
| ***F04D 1/06*** | (2006.01) |
| ***F04D 29/24*** | (2006.01) |

(52) U.S. Cl.

CPC ..... *F04D 13/10* (2013.01); *F04D 1/063* (2013.01); *F04D 1/08* (2013.01); *F04D 1/10* (2013.01); *F04D 29/242* (2013.01)

(58) Field of Classification Search

CPC ..... F04D 1/06; F04D 1/10; F04D 29/2722; F04D 29/242; F04D 29/245

USPC ..... 416/228, 235, 236 R, 236 A, 237, 223 B, 416/185, 186 R; 415/199.1, 199.3

See application file for complete search history.

(56) References Cited

U.S. PATENT DOCUMENTS

| | | | | |
|---|---|---|---|---|
| 2,266,180 | A * | 12/1941 | Emerick | 416/186 R |
| 7,549,837 | B2 * | 6/2009 | Hackworth et al. | 415/120 |
| 2009/0092478 | A1 | 4/2009 | Eslinger | |
| 2010/0221105 | A1 | 9/2010 | Markovitch | |
| 2010/0239417 | A1 | 9/2010 | Scott | |
| 2010/0284812 | A1 | 11/2010 | Zahdeh | |

FOREIGN PATENT DOCUMENTS

| | | |
|---|---|---|
| JP | 2002364591 | 12/2002 |

* cited by examiner

*Primary Examiner* — Edward Look
*Assistant Examiner* — Jason Mikus
(74) *Attorney, Agent, or Firm* — Bracewell & Giuliani LLP

(57) ABSTRACT

A centrifugal pumping system having a stack of impellers and diffusers for pressurizing fluid. The impellers are rotated by a motor for pressurizing and lifting fluid from within a wellbore. Undulating profiles are provided on leading edges of the impellers for inducing turbulence in the fluid being pumped. Increasing turbulence better homogenizes the fluid, so that choked flow is avoided when different density components are present in the fluid. Reducing the possibility of choked flow increases pump efficiency and lift capacity.

16 Claims, 4 Drawing Sheets

Fig. 2
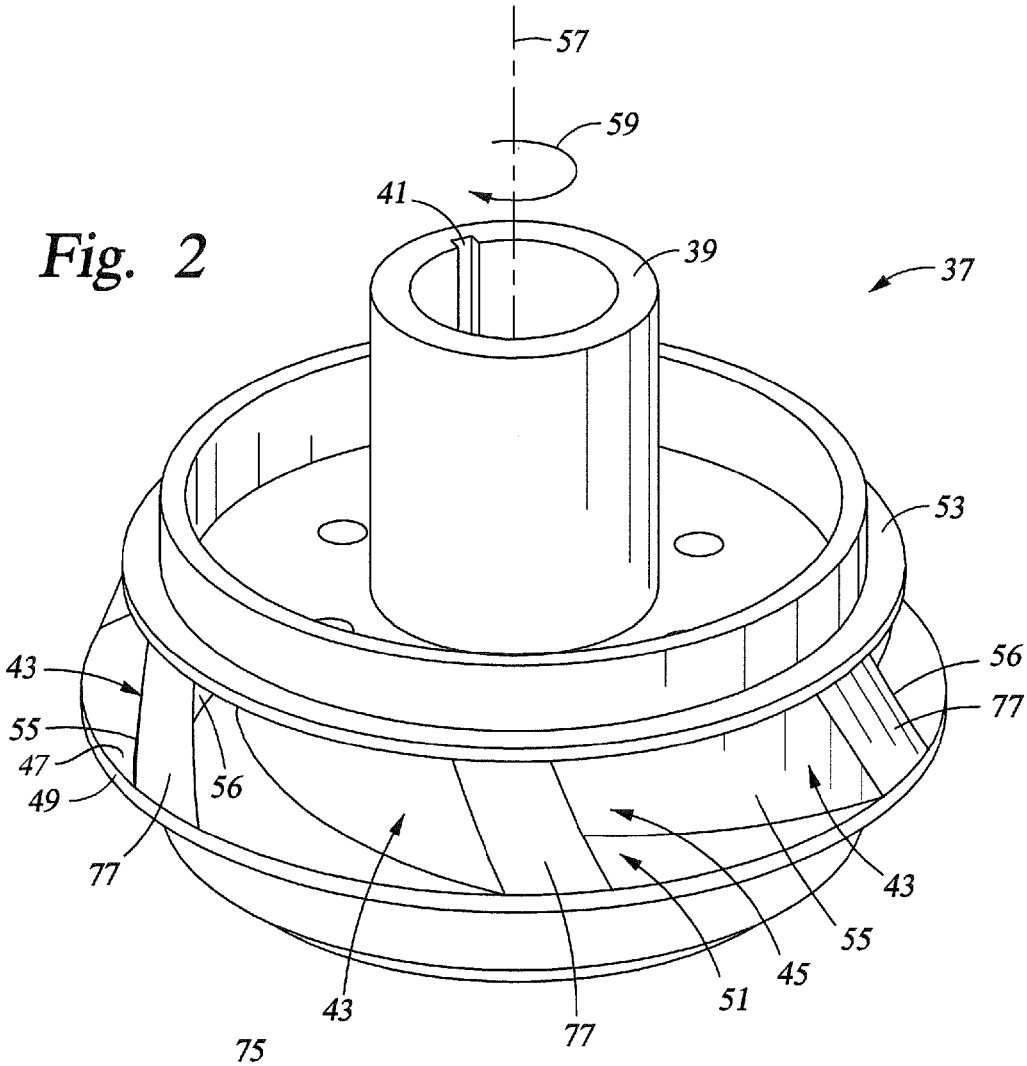
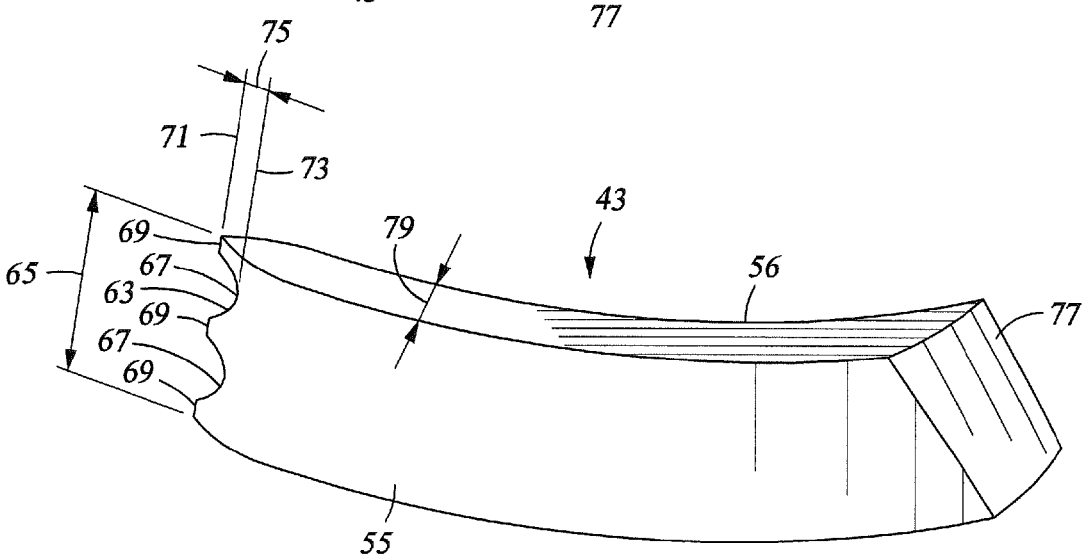
Fig. 3

IMPELLER VANE WITH LEADING EDGE ENHANCEMENT

RELATED APPLICATIONS

This application claims priority to and the benefit of U.S. Provisional Application Ser. No. 61/557,448, filed Nov. 9, 2011, the full disclosure of which is hereby incorporated by reference herein.

BACKGROUND OF THE INVENTION

1. Field of the Invention

This invention relates in general to electric submersible pumps (ESPs) and, in particular, to an impeller vane with a leading edge profiled to increase turbulence in fluid contacting the leading edge.

2. Description of Prior Art

Submersible pumping systems are often used in hydrocarbon producing wells for pumping fluids from within the wellbore to the surface. These fluids are generally liquids and include produced liquid hydrocarbon as well as water. One type of system used employs an electrical submersible pump (ESP). ESPs are typically disposed at the end of a length of production tubing and have an electrically powered motor. Often, electrical power may be supplied to the pump motor via a cable. The pumping unit is usually disposed within the well bore just above where perforations are made into a hydrocarbon producing zone.

Centrifugal submersible pumps typically employ a stack of rotatable impellers and stationary diffusers, where the impellers and diffusers alternate in the stack and are arranged coaxial with one another. Passages provided through both the impellers and diffusers define a flow path through which fluid is forced while being pressurized in the pump. Changes in density of the fluid being pumped, such as gas or emulsions in the fluid, can choke flow through the pump thereby decreasing pump efficiency and capacity.

SUMMARY OF INVENTION

Disclosed herein is an example of an electric submersible pump (ESP) that has an increased efficiency, especially when fluid is being pumped that has a non-uniform density. In one example the ESP is made up of a motor, a shaft coupled to and selectively rotated by the motor, and a pump. In this example, pump includes a plurality of the impellers having a fluid inlet, an annular hub coupled to the shaft, flow passages extending radially and or axially between the hub and an outer periphery of the impeller, and a vane between the flow passages that extends radially between the hub and an outer periphery of the impeller. An undulating profile is provided on an end of the vane that faces the hub, where the profile defines a leading edge. Thus when fluid from the fluid inlet contacts the leading edge, turbulence is increased in the fluid to mix the fluid and homogenize the fluid and prevent any choked flow. The vane can have a cross section with an elongate side, and wherein the undulating profile extends along the elongate side. The pump can further include an upper shroud and a lower shroud, where the shrouds extend radially outward from the hub to the outer periphery of the impeller and are respectively set on upper and lower surfaces of the vane. In an example, the fluid inlet is formed axially through the lower shroud, and the leading edge is proximate the fluid inlet. Alternatively, the undulating profile is made of undulations that each have about the same height and length, or the undulations that each have a different height and length. An outer surface of the vane between the leading edge and outer periphery of the impeller can be substantially planar. In an optional embodiment, the undulating profile has two undulations, but may alternatively have more than two undulations. The thickness of the vane can decrease proximate the leading edge.

Also disclosed herein is an example of an electric submersible pump (ESP) system for use in a wellbore that includes a motor section having a motor, a pump section, a shaft coupled to and selectively rotated by the motor, and a stack of impellers in the pump section. In this example each impeller has an annular hub coupled to the shaft that is rotatable with rotation of the shaft, vanes that project radially between the hub and an outer periphery of the impeller and that are spaced apart to define flow passages between adjacent vanes, fluid inlets to each flow passage disposed adjacent the hub, a fluid flow path in each flow passage extending from each fluid inlet, in each passage along vanes adjacent each passage, and towards the outer periphery of each impeller, and an undulating profile on an end of each vane proximate the hub that defines a leading edge and that is in a fluid flow path. The undulating profile perturbs flow, so that when fluid flows along the fluid flow path and against the leading edge, turbulence is increased in the flowing fluid to mix the fluid. The ESP can further include diffusers in the pump section coaxially disposed between each adjacent impeller. Each undulating profile on the vane can be disposed along a path adjacent an interface between the vane and an adjacent flow passage. In one embodiment, each vane has a cross section with an elongate side, and wherein the undulating profile extends along the elongate side. Optionally, each undulating profile comprises undulations of about the same size or have a different size. An upper shroud can be included with each impeller that extends from the hub radially outward to the outer periphery of the impeller and covers a lateral side of each vane, and a lower shroud with each impeller that extends from the hub radially outward to the outer periphery of the impeller and covers a lateral side of each vane distal from the upper shroud.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

FIG. 2 is a perspective representation of an impeller of the electric submersible pump assembly of FIG. 1.

FIG. 3 is a partial perspective view of a vane of the impeller of FIG. 2.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning ESP operation, construction, and the like have been omitted inasmuch as such details are not considered necessary to obtain a complete understanding of the present invention, and are considered to be within the skills of persons skilled in the relevant art.

Figure 1:
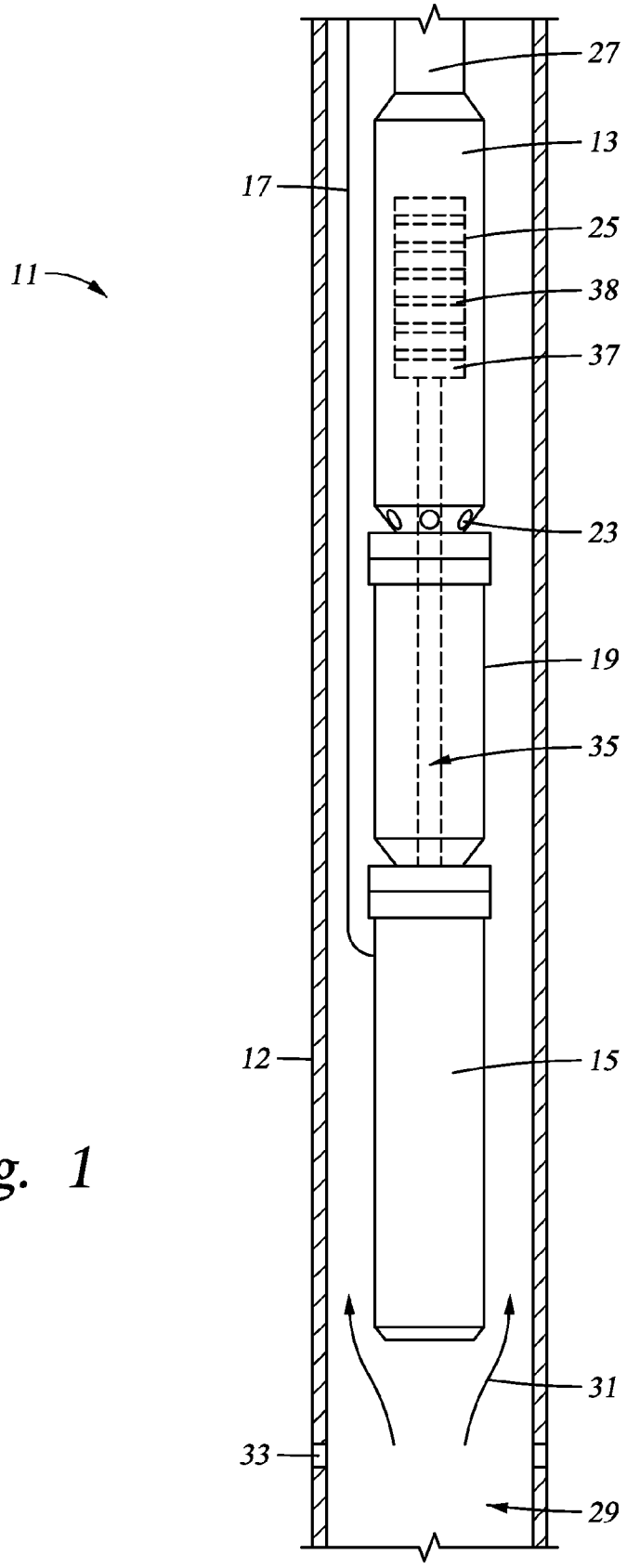
FIG. 1 is a schematic view of an electric submersible pump assembly disposed within a wellbore.

With reference now to FIG. 1 an example of an electrical submersible pumping (ESP) system 11 is shown in a side partial sectional view. ESP 11 is disposed in a wellbore 29 that is lined with casing 12. In the embodiment shown, ESP 11 includes pump 13 on an upper portion that is driven by a motor 15. Pump motor 15 is energized via a power cable 17 that connects to an electrical source (not shown). A seal section 19 is further shown attached on the upper end of the motor 15 and between pump 13. Fluid inlets 23 shown on the outer housing of pump 13 provide communication from outside of the pump 13 to an impeller stack 25 shown in dashed outline in the pump 13. Fluid 31 flows from a formation surrounding the casing 12, through perforations 33 in the casing 12, up the wellbore 29, and to inlets 23 for wellbore fluid 31 in wellbore 29. Through the inlets 23, fluid 31 enters into pump section 13 where it is directed to the impeller stack 25. Wellbore fluid 31 can include liquid hydrocarbon, gas hydrocarbon, and/or water; a gas separator and a fluid intake (not shown) may be mounted between seal section 19 and pump section 13.

Motor 15 rotates an attached shaft assembly 35 (shown in dashed outline). Although shaft 35 is illustrated as a single member, it should be pointed out that shaft 35 may comprise multiple shaft segments. Shaft assembly 35 extends from motor 15 through seal section 19 to pump section 13 where it connects to and drives impeller stack 25, thus stack 25 and rotates in response to shaft 35 rotation. Impeller/diffuser stack 25 includes a vertical stack of individual impellers 37 alternatingly interspaced between static diffusers 38. Wellbore fluid 31 drawn into pump 13 from inlets 23 is pressurized as the stack of rotating impellers 25 urge wellbore fluid 31 through a helical labyrinth upward through pump 13. The pressurized fluid is directed to the surface via production tubing 27 attached to the upper end of pump 13.

In an exemplary embodiment, impeller stack 25 includes one or more impellers 37 illustrated in FIG. 2. Impeller 37 is a rotating pump member that accelerates fluid 31 (FIG. 1) by imparting kinetic energy to fluid 31 through rotation of impeller 37. Impeller 37 has a central bore defined by the inner diameter of impeller hub 39. Shaft 35 (FIG. 1) passes through the central bore of impeller hub 39. Impeller 37 may engage shaft 35 by any means including, for example, splines (not shown) or keyways 41 that cause impeller 37 to rotate with shaft 35 (FIG. 1).

As shown in example of FIG. 2, impeller 37 includes a plurality of vanes 43. Vanes 43 project radially through impeller 37 between an interior of impeller 37 proximate to hub 39 and an impeller edge 49 distal from hub 39. Impeller vanes 43 follow a curved path between hub 39 and edge 49, and may be attached to or integrally formed with impeller hub 39. Vanes 43 may extend radially from impeller hub 39 and may be normal to shaft 35, or may extend at an angle. In the illustrated embodiment, vanes 43 are curved as they extend from impeller hub 39 so that a convex portion of each vane 43 extends in the direction of rotation. Passages 45 are formed between surfaces of vanes 43. Impeller 37 may rotate on shaft 35 (FIG. 1) about axis 57 passing through hub 39 in the direction indicated by arrow 59. As impeller 37 rotates, fluid may be directed into passages 45 through an impeller inlet 51 that communicates with a lower surface of impeller 37. Fluid accelerated by rotating impeller 37 in vane 43 flows towards high pressure surface 55 and then is directed out of the associated passage 45. High pressure surface 55 may be a surface of vane 43 that contacts and pressurizes fluid as described in more detail below. Each vane 43 also has a low pressure surface 56 on an opposite side of vane 43 from high pressure surface 55.

A lower shroud 47 forms an outer edge of impeller 37 and may be attached to or join an edge of each vane 43. Lower shroud 47 defines a planar surface intersected by axis 57 and adjacent a lower lateral side of impeller 37. In some embodiments, lower shroud 47 is attached to impeller hub 39, either directly or via vanes 43. In some embodiments, impeller hub 39, vanes 43, and lower shroud 47 are all cast or manufactured as a single piece of material. Lower shroud 47 may have a lower lip for engaging an impeller eye washer on a diffuser. The lower lip may be formed on the bottom surface of lower shroud 47. Lower shroud 47 defines impeller inlet 51 on a lower side of lower shroud 47. Impeller inlet 51 allows fluid flow from below impeller 37 into passages 45 defined by vanes 43.

Each impeller 37 includes impeller edge 49 that is a surface on an outer radial portion of impeller 37. In an exemplary embodiment, impeller edge 49 is the outermost portion of lower shroud 47. Impeller edge 49 need not be the outermost portion of impeller 37. The diameter of impeller edge 49 is slightly smaller than an inner diameter of a diffuser in which impeller 37 is positioned.

Further in the example of FIG. 2, impeller 37 includes an upper shroud 53 located opposite lower shroud 47 and joins an upper lateral edge of each vane 43. Upper shroud 53 generally defines an upper boundary of passages 45 between vanes 43. Upper shroud 53 may seal against an upthrust washer (not shown) of a diffuser 38 (FIG. 1) disposed above impeller 37. A downthrust washer (not shown) may be located between a downward facing surface of impeller 37 and an upward facing surface of a diffuser 38 disposed below impeller 37.

Within a single pump housing, one or more of the plurality of impellers 37 may have a different design than one or more of the other impellers 37, such as, for example, impeller vanes 43 having a different pitch. A plurality of impellers 37 may be installed on shaft 35 (FIG. 1). Diffusers 38 are installed, alternatingly, between impellers 37. The assembly having shaft 35, impellers 37, and diffusers 38 are installed in pump 13.

Figure 4:
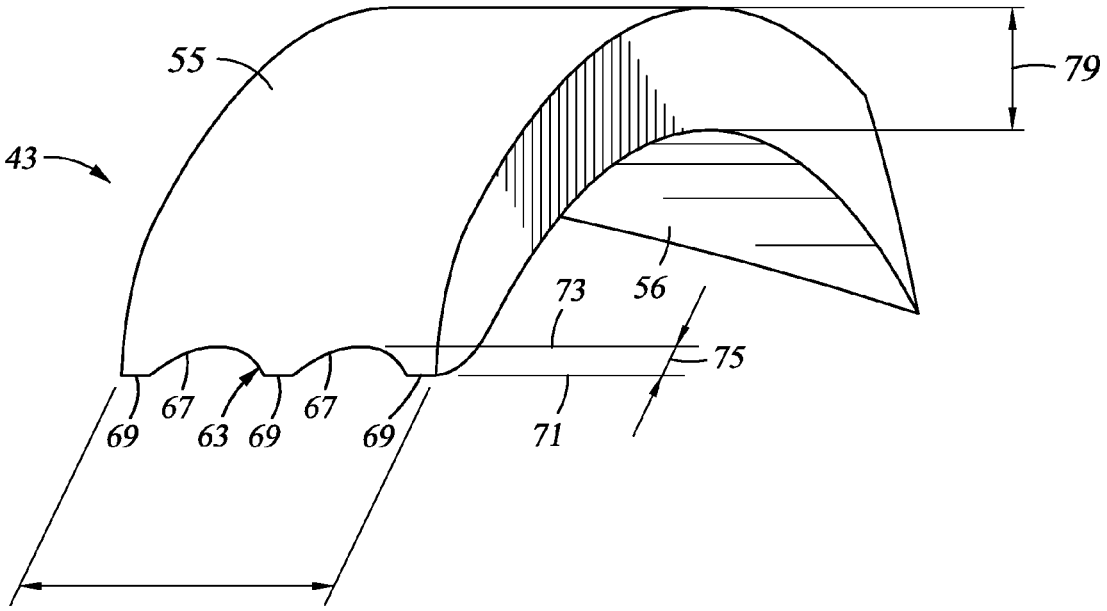
FIG. 4 is a top perspective view of the vane of FIG. 3.
Figure 5:
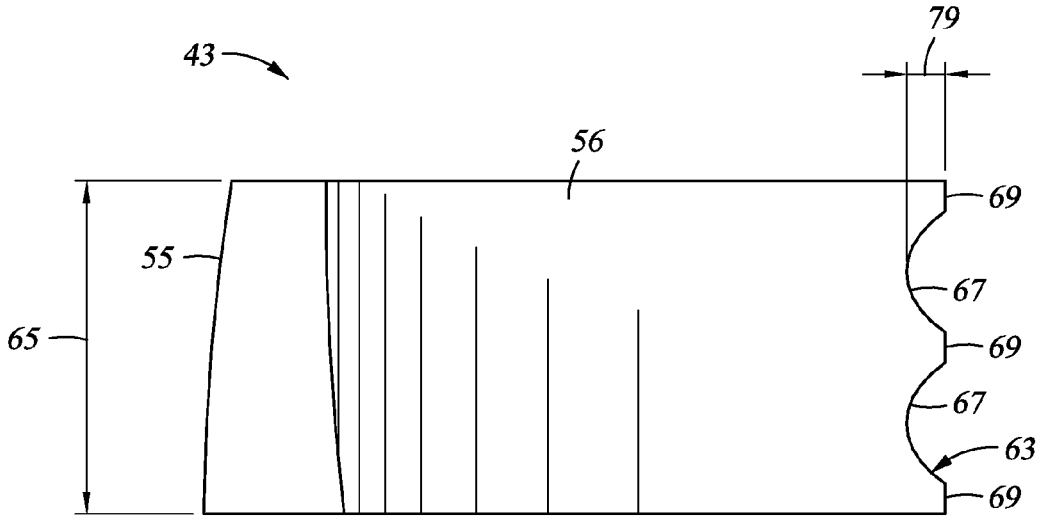
FIG. 5 is a front perspective view of the vane of FIG. 3.

Referring to FIGS. 3-5, an exemplary portion of vane 43 is shown in a side perspective view and with high pressure surface 55 on its outer radial periphery. As shown in FIG. 2, high pressure surface 55 may extend between lower shroud 47 and upper shroud 53. High pressure surface 55 of FIG. 3 may also be proximate to inlet 51 (FIG. 2). As shown in FIG. 3, each vane 43 includes a curvilinear leading edge 63 formed on a portion of vane 43 proximate to hub 39 (FIG. 2). In an example, leading edge 63 extends a height 65 of vane 43 from upper shroud 53 to lower shroud 47. Leading edge 63 has an undulating profile in a direction along height 65. In an example, leading edge 63 defines an edge joining high pressure surface 55 and low pressure surface 56, and as shown in FIG. 4 has a thickness that decreases proximate its terminal end. The undulating profile of leading edge 63 defines depressions 67 and extensions 69; wherein depressions 67 depend inwardly toward vane 43 from a line 71 encompassing apexes of extensions 69, and extensions 69 depend outwardly away from vane 43 from a line 73 encompassing low points of depressions 67. Line 71 and line 73 may be separated by an amplitude or distance 75 of extensions 69. High pressure surface 55 may have a uniform surface extending from line 73 to a trailing edge or surface 77 as shown in FIG. 4. High pressure surface 55 and low pressure surface 56 tapers from a depth 79 to leading edge 63 at a rate such that high pressure surface 55 and low pressure surface 56 are substantially smooth across leading edge 63 as shown in FIGS. 4 and 5.

In an example of operation, impeller 37 rotates in the direction indicated by arrow 59 of FIG. 2, and fluid passing through inlet 51 flows across leading edge 63 and is pressurized and accelerated along high pressure surface 55. Depressions 67 and extensions 69 increase the turbidity of the flow across high pressure surface 55 by inducing vortices in the fluid as it flows across extensions 69 and depressions 67. These vortices can increase the rate of mixing of fluid flowing through passage 45 (FIG. 2) and, consequently, increase fluid flow through passage 45. By increasing the rate of mixing in passage 45, gas may not build up along low pressure surface 56 as in the prior art; thus, the disclosed embodiments decrease instances of gas lock and choking of ESP 11 (FIG. 1).

A person skilled in the art will recognize that there may be significant variation in the contour of leading edge 63. For example, distance 75 may be varied as needed to accommodate the type of flow and the type of impeller in which vane 43 is positioned. Similarly, while extensions 69 and depressions 67 are shown evenly spaced across leading edge 63 in FIG. 3, a person skilled in the art will recognize that extensions 69 and depressions 67 may be unevenly spaced, have different distances 75 from an apex of an extension 69 to a nadir of a depression 67 from adjacent extensions 69 and depressions 67. There also may be more or fewer extensions 69 and depressions 67 between upper shroud 53 and lower shroud 47. Leading edge 63 may also comprise a surface having a depth between high pressure surface 55 and low pressure surface 56. In still other embodiments, trailing edge or surface 77 may include extensions and depressions similar to leading edge 63.

Figure 6:
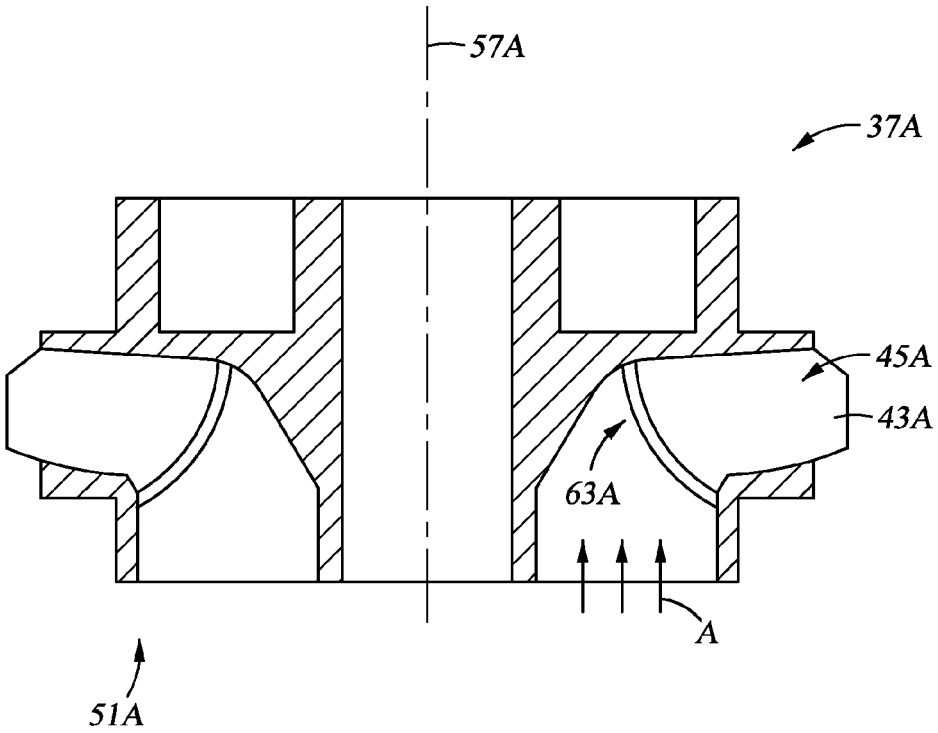
FIG. 6 is a side sectional view of an alternate embodiment of an impeller.

An alternate embodiment of an impeller 37A is shown in a side sectional view in FIG. 6. In this example, a leading edge 63A of vane 43A extends along a path generally oblique to axis 57A of impeller 37A and in the path of fluid, represented by arrows A, flowing from inlet 51A into passage 45A. Leading edge 63A of FIG. 6 is formed to have a generally discontinuous surface, that sufficiently perturbs fluid flowing from inlet 51A to passage 45A to increase turbulence of the fluid. In an example, a discontinuous surface describes a surface having a portion that disposed outside of a plane that intersects adjacent portions. Examples include surfaces with projections or depressions formed thereon. Thus as the fluid flows over a discontinuous surface, velocity changes in the fluid that contacts or otherwise encounters the discontinuities.

Figure 7:
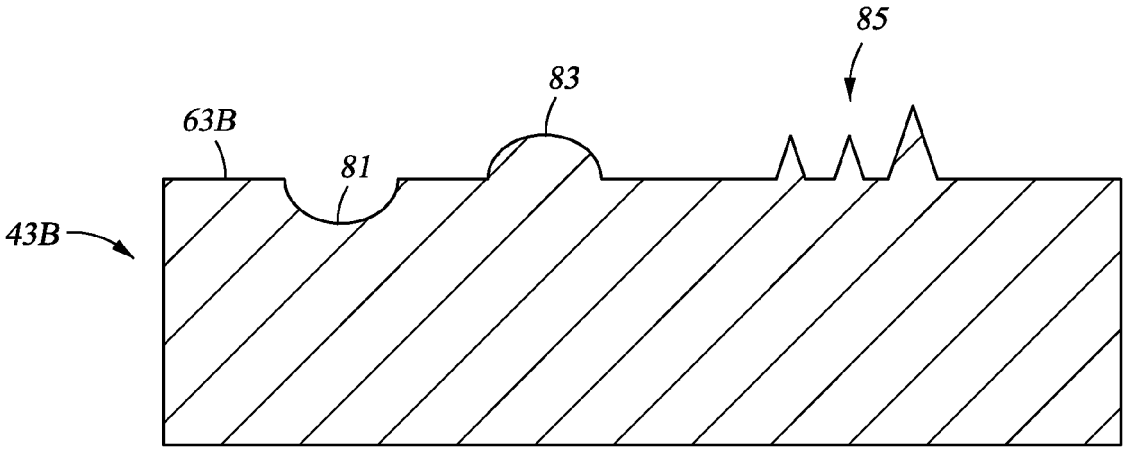
FIG. 7 is a sectional view of an alternate embodiment of a leading edge of an impeller.

Shown in side sectional view in FIG. 7 is an example of a leading edge 63B of a vane 43B having discontinuities for perturbing fluid flow to increase turbulence. The discontinuities include a depression 81 formed into the surface 63B, a rounded projected 83 that extends away from the surface of the leading edge 63B. Also shown are peaked projections 85 that can have varying widths and heights. Thus example leading edges 63B can include multiple depressions 81, rounded projections 83, peaked projections 85, as well as combinations of these elements. The discontinuities on the surface 63B are not limited to those illustrated, but can include any symmetric or asymmetric shape or configuration, including generally rectangular shapes.

Accordingly, the disclosed embodiments provide numerous advantages. For example, the disclosed embodiments will improve pump performance and operating range. In addition, the disclosed embodiments will increase turbulence in the pump that will break any choking or stagnation within the impeller and limit gas collection, thereby increasing lift. Still further, the disclosed embodiments may accomplish this without any substantial change in drag forces within the impeller.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. For example, considered with the present disclosure are embodiments of an ESP 11 that include a gas separator equipped with the examples of the impellers described herein. Accordingly, it is appropriate that the appended claims be construed broadly and in a manner consistent with the scope of the invention.

What is claimed is:

1. An electric submersible pump (ESP) comprising:
- a motor;
- a shaft coupled to and selectively rotated by the motor; and
- a centrifugal pump having a plurality of stages, each stage having an impeller and a diffuser, and each impeller having,
  - a fluid inlet,
  - an annular hub coupled to the shaft;
  - flow passages extending radially between the hub and an outer periphery of the impeller,
  - a vane between the flow passages that extends radially between the hub and an outer periphery of the impeller,
  - a leading edge on an end of the vane proximate the hub having a discontinuous surface, so that when fluid from the fluid inlet contacts the leading edge, turbulence is increased in the fluid to mix the fluid; and
  - wherein the discontinuous surface is profiled with projections protruding from the leading edge.

2. The ESP of claim 1, wherein the projections comprise undulations extending along an elongate side of the leading edge.

3. An electric submersible pump (ESP) comprising:
- a motor;
- a shaft coupled to and selectively rotated by the motor;
- a centrifugal pump having a plurality of stages, each stage having an impeller and a diffuser, and each impeller having, a fluid inlet, an annular hub coupled to the shaft;

flow passages extending radially between the hub and an outer periphery of the impeller, a vane between the flow passages that extends radially between the hub and an outer periphery of the impeller, a leading edge on an end of the vane proximate the hub having a discontinuous surface, so that when fluid from the fluid inlet contacts the leading edge, turbulence is increased in the fluid to mix the fluid; wherein an upper shroud and a lower shroud that extend radially outward from the hub, to the outer periphery of the impeller, are respectively set on upper and lower surfaces of the vane; and the fluid inlet is formed axially through the lower shroud, and the leading edge is proximate the fluid inlet.

4. The ESP of claim 1, wherein the projections comprise undulations that each have about the same height and length.

5. The ESP of claim 1, wherein the projections comprise undulations that each have a different height and length.

6. The ESP of claim 1, wherein a high pressure surface of the vane between the leading edge and outer periphery of the impeller is free of the projections.

7. The ESP of claim 1, wherein the projections comprise two undulations.

8. The ESP of claim 1, wherein the projections comprise more than two undulations.

9. The ESP of claim 1, wherein a thickness of the vane decreases proximate the leading edge.

10. An electric submersible pump (ESP) system for use in a wellbore comprising:

a motor section having a motor;

a pump section;

a shaft coupled to and selectively rotated by the motor; and a stack of impellers in the pump section that each comprise, an annular hub coupled to the shaft that is rotatable with rotation of the shaft;

vanes that project radially between the hub and an outer periphery of the impeller and that are spaced apart to define flow passages between adjacent vanes, fluid inlets to each flow passage disposed adjacent the hub, a fluid flow path in each flow passage extending from each fluid inlet, in each passage along vanes adjacent each passage, and towards the outer periphery of each impeller, an undulating profile on an end of each vane proximate the hub that defines a leading edge and that is in a fluid flow path, so that when fluid flows along the fluid flow path and against the leading edge, turbulence is increased in the flowing fluid to mix the fluid.

11. The ESP system of claim 10, further comprising diffusers in the pump section coaxially disposed between each adjacent impeller.

12. The ESP system of claim 10, wherein each undulating profile on the vane is along a path adjacent an interface between the vane and an adjacent flow passage.

13. The ESP system of claim 10, wherein each vane has a cross section with an elongate side, and wherein the undulating profile extends along the elongate side.

14. The ESP system of claim 10, wherein each undulating profile comprises undulations of about the same size.

15. The ESP system of claim 10, wherein each undulating profile comprises undulations of having a different size.

16. The ESP system of claim 10, further comprising an upper shroud with each impeller that extends from the hub radially outward to the outer periphery of the impeller and covers a lateral side of each vane, and a lower shroud with each impeller that extends from the hub radially outward to the outer periphery of the impeller and covers a lateral side of each vane distal from the upper shroud.

* * * * *